US009061513B2

(12) United States Patent
Shrader

(10) Patent No.: US 9,061,513 B2
(45) Date of Patent: Jun. 23, 2015

(54) INK RESERVOIR CONTAINING STRUCTURE

(75) Inventor: Eric J. Shrader, Belmont, CA (US)

(73) Assignee: Palo Alto Research Center Incorporated, Palo, Alto, CA (US)

( * ) Notice: Subject to any disclaimer, the term of this patent is extended or adjusted under 35 U.S.C. 154(b) by 150 days.

(21) Appl. No.: 13/273,811

(22) Filed: Oct. 14, 2011

(65) Prior Publication Data

US 2013/0093812 A1 Apr. 18, 2013

(51) Int. Cl.
*B41J 2/175* (2006.01)
*B41J 29/02* (2006.01)

(52) U.S. Cl.
CPC ..... *B41J 2/17593* (2013.01); *B41J 29/02* (2013.01)

(58) Field of Classification Search
USPC ..... 347/85, 86, 88, 93, 7, 17
See application file for complete search history.

(56) References Cited

U.S. PATENT DOCUMENTS

| | | | | |
|---|---|---|---|---|
| 5,657,065 | A * | 8/1997 | Lin | 347/93 |
| 6,276,790 | B1 * | 8/2001 | Ikezaki | 347/88 |
| 6,460,985 | B1 | 10/2002 | Olsen et al. | |
| 6,827,431 | B2 * | 12/2004 | Kitabatake et al. | 347/86 |
| 2004/0114008 | A1 | 6/2004 | Leighton et al. | |
| 2011/0141212 | A1 | 6/2011 | Smith et al. | |
| 2012/0147105 | A1 * | 6/2012 | Jones et al. | 347/88 |

* cited by examiner

*Primary Examiner* — Lam Nguyen
(74) *Attorney, Agent, or Firm* — Hollingsworth Davis, LLC

(57) ABSTRACT

Ink reservoir subassemblies for phase change ink can be designed and configured to include at least one structure comprising elements disposed within the ink reservoir. The elements may include fibers and/or beads that occupy a majority of a volume of the reservoir. The elements may provide enhanced thermal conductivity, ink filtering and/or bubble reduction.

20 Claims, 10 Drawing Sheets

INK RESERVOIR CONTAINING STRUCTURE

FIELD

The present disclosure relates generally to methods and devices useful for ink jet printing.

SUMMARY

Embodiments described in this disclosure involve ink reservoir subassemblies for phase change ink including an ink reservoir and at least one structure comprising one or more thermally conductive elements disposed within the ink reservoir and arranged to increase a thermal conductivity within the ink reservoir. According to various implementations, the thermally conductive elements may comprise one or more of fibers, beads, or other elements, e.g., metallic elements. In some implementations, the thermally conductive elements can have a thermal conductivity in a range of about 10 to about 430 W/m-K. Some aspects include that the thermally conductive elements have an average diameter of about 30 μm. In some embodiments, pores between the thermally conductive elements have an average cross sectional area of about 705 $\mu m^2$.

In some cases, the at least one structure occupies a majority of a volume of the reservoir. In some cases, the at least one structure comprises several structures that occupy separate regions within the reservoir. The ink reservoir subassembly may include heaters configured to heat the ink. The heaters may be thermally and/or mechanically coupled to the at least one structure.

According to some aspects, the reservoir includes one or more thermally conductive fins disposed within the reservoir that may extend from a wall of the reservoir into an interior of the reservoir. The least one structure may be mechanically coupled to the fins. The ink reservoir subassembly may comprise heaters that are mechanically and/or thermally coupled to the fins. In some implementations, at least one structure is mechanically coupled to the heaters.

Embodiments described herein include an ink jet printer having one or more ink reservoirs and at least one structure comprising thermally conductive elements, such as fibers or beads, disposed within at least one ink reservoir. The ink jet printer also includes a heater configured to heat the ink to a temperature above a melting point of the ink. The ink jet printer medium according to a predetermined pattern and a transport mechanism configured includes a print head comprising ink jets configured to eject the ink toward a print to provide relative movement between the print medium and the print head.

Some aspects involve a method of fabricating a reservoir subassembly for a phase change ink jet printer. A reservoir configured to contain a phase change ink is provided. At least one structure that occupies a substantial volume of the reservoir is disposed within the reservoir.

Some implementations include that the at least one structure comprises fibers, beads and/or other elements are disposed within the reservoir. According to some aspects, the elements are fibers and/or beads having an average diameter of about 30 μm.

According to some aspects, the structure comprises randomly oriented fibers or beads. In some implementations, the structure comprises woven fibers. According to some cases, the structure comprises fibers and/or beads having an average diameter in a range of about 10 μm to about 50 μm. In some embodiments, the structure comprises fibers and/or beads and an average cross sectional area of pores between the fibers and/or beads is in a range of about 75 $\mu m^2$ to about 8000 $\mu m^2$.

Various aspects described in this disclosure involve a method of operating an ink jet printer. A phase change ink is contained within a volume of an ink reservoir of the ink jet printer, the phase change ink having a thermal conductivity, $k_i$. A thermal structure is disposed within the ink reservoir and occupies at least about 25% of a volume of the reservoir. The thermal structure increases a thermal conductivity within the volume to a thermal conductivity, $k_i+\Delta$.

The above summary is not intended to describe each embodiment or every implementation. A more complete understanding will become apparent and appreciated by referring to the following detailed description and claims in conjunction with the accompanying drawings.

DESCRIPTION OF VARIOUS EMBODIMENTS

Ink jet printers operate by ejecting small droplets of liquid ink onto print media in a predetermined pattern. In some cases, the ink is ejected directly onto a print media, such as paper or a print drum. Solid ink printers have the capability of using a phase change ink which is solid at room temperature and is melted before being ejected onto the print media surface. Phase change inks that are solid at room temperature allow the ink to be transported and loaded into the ink jet printer in solid form, without the packaging or cartridges typically used for liquid inks. The solid ink is placed in a reservoir where it is heated above its melting temperature to liquid form. During operation of the printer, the ink is maintained above the melting temperature so that the liquid ink can be ejected onto the print media.

Phase change ink in an ink jet printer undergoes freeze/thaw cycles when the printer is powered down and powered up. When power is removed from the printer for a sufficient period of time, the temperature of the ink drops and causes the ink to freeze. Upon power-up of the printer, the ink temperature begins to rise and during warm-up, and the ink temperature continues to rise until the ink temperature is above the melting point. The time it takes to thaw the ink after a power down of the printer is a factor in the warm-up time of the printer. Furthermore, freeze/thaw cycles create bubbles in the ink which impact print quality. Embodiments described in this disclosure involve approaches for decreasing the warm-up time and decreasing bubble formation in ink jet printers that use phase change ink.

Figure 1:
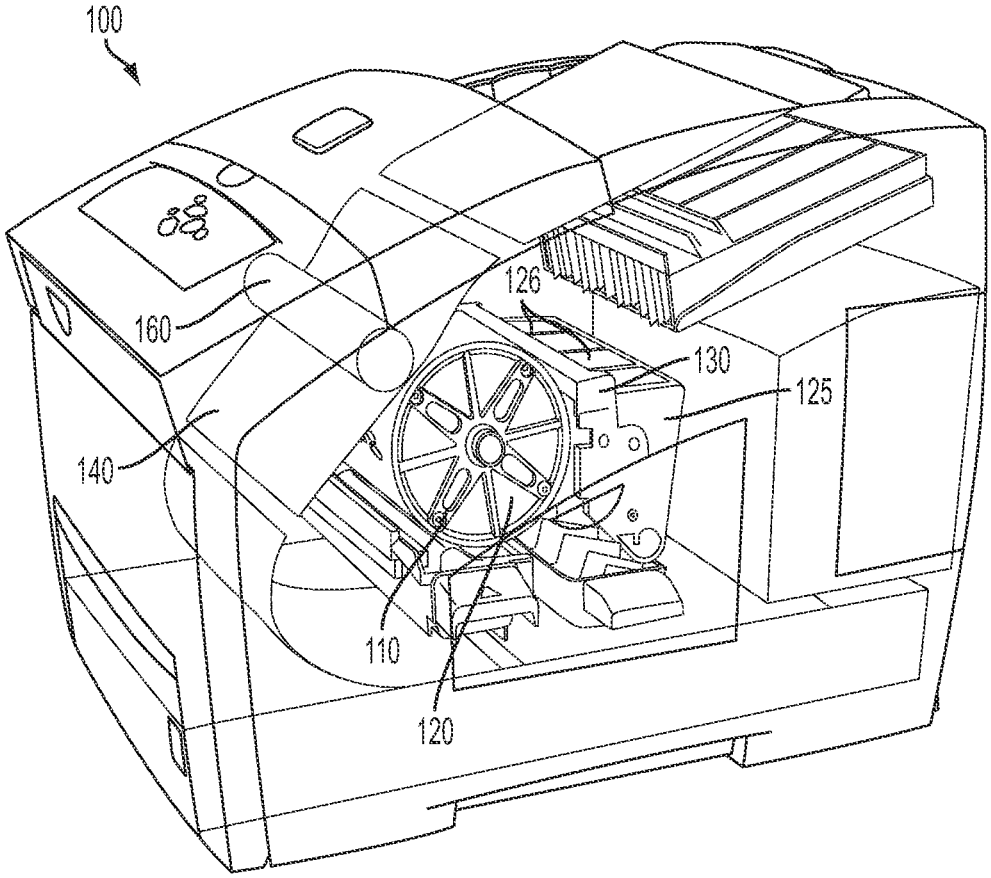
FIG. 1 provides an internal view of a portion of an ink jet printer that incorporates at least one structure within the reservoir subassembly in accordance with embodiments described herein.

FIG. 1 provides an internal view of a portion of an ink jet printer 100 configured to incorporate at least one structure within the reservoir subassembly 125 as discussed herein. The reservoir subassembly 125 includes openings 126 for receiving the ink in solid form. Reservoir subassemblies for color printers may include multiple reservoirs, at least one reservoir for each printer color, for example. A multi-reservoir subassembly can include at least one structure in each reservoir, also referred to herein as a mass. In some cases, the structure may be thermally conductive. The reservoir subassembly 125 includes an ink heater (not shown in FIG. 1) thermally coupled to the ink in the reservoir(s). The solid ink in the reservoir(s) is melted by the ink heater.

A transport mechanism 110 is configured to move the drum 120 relative to the print head 130 and to move the paper 140 relative to the drum 120. Molten ink from the reservoir 125 is fed to the print head 130. The print head 130 may extend fully or partially along the length of the drum 120 and includes a number of ink jets. As the drum 120 is rotated by the transport mechanism 110, ink jets of the print head 130 deposit droplets of ink though ink jet apertures onto the drum 120 in the desired pattern. As the paper 140 travels around the drum 120, the pattern of ink on the drum 120 is transferred to the paper 140 through a pressure nip 160.

Figure 2:
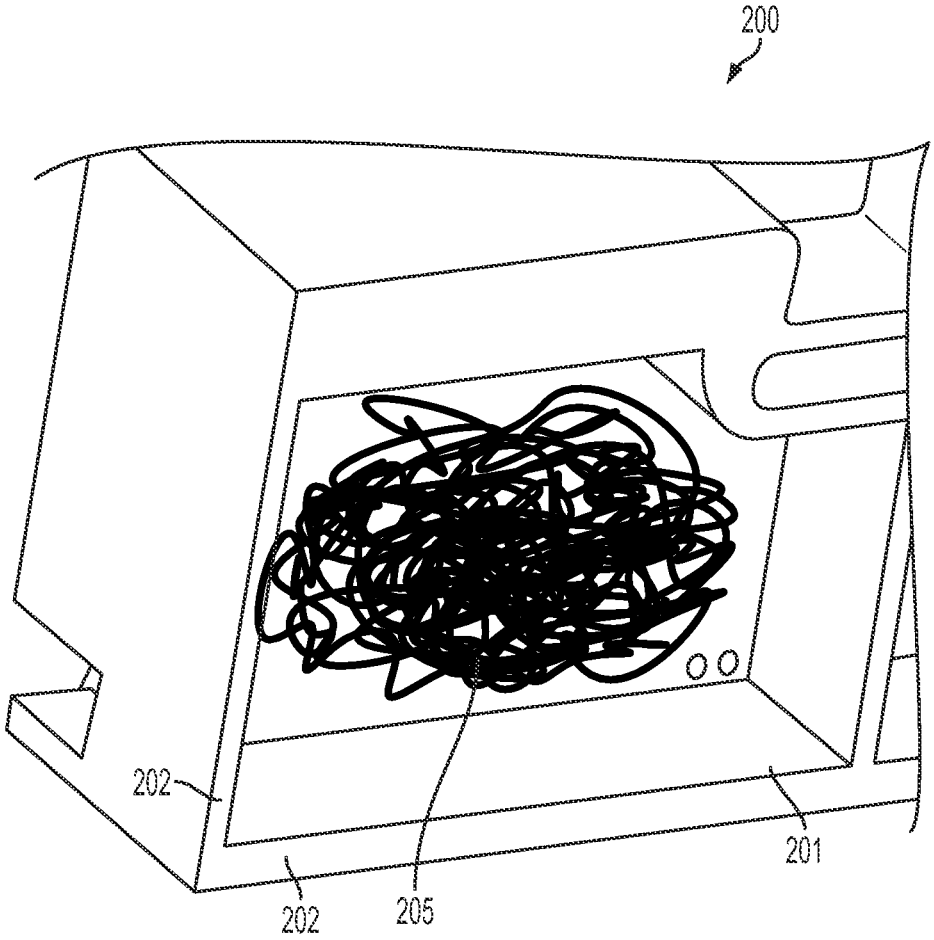
FIG. 2 shows one reservoir of a multi-reservoir subassembly that contains a structure in accordance with various embodiments.

FIG. 2 shows one reservoir 201 of a multi-reservoir subassembly 200. The reservoir 201 includes reservoir walls 202 that are configured to contain the ink within the reservoir 201. Disposed within the reservoir 201 is at least one structure 205. The reservoir 201 may contain only one structure or multiple separate structures may be disposed within the reservoir. Structure 205 is made up of one or more elements, e.g., fibers, beads, and/or other elements which may provide one or more attributes to the structure. In some configurations, structure 205 may be a thermally conductive structure that increases the thermal conductivity within the reservoir 201. For example, the thermal conductivity in a reservoir without the structure 205 may be less than the thermal conductivity of a substantially similar reservoir 201 that contains the structure 205. In some configurations, structure 205 additionally or alternatively provides ink filtering and/or bubble reduction. In some configurations, structure 205 comprises one or more elements, e.g. fibers and/or sintered beads that provide nucleation sites for void formation as the ink is freezing. The nucleation sites result in smaller, more numerous bubbles which are more likely to dissolve when the ink re-melts. Note that depictions of the structures, elements and other ink jet printer components provided in the Figures herein are used for illustrative purposes and are not necessarily shown to scale.

Figure 3:
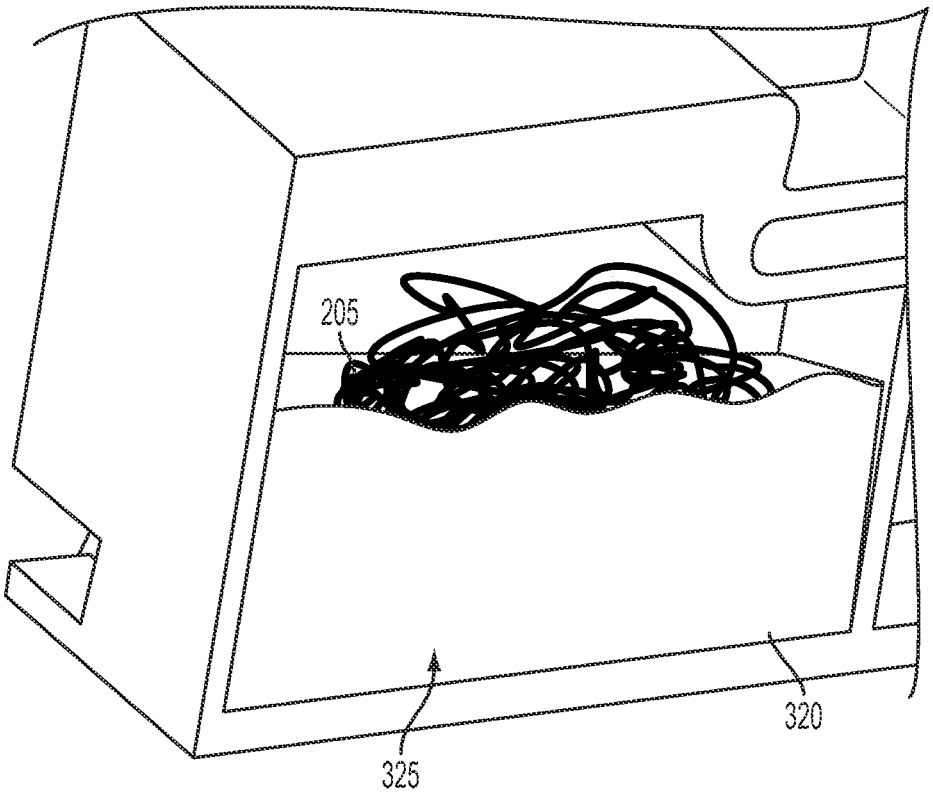
FIG. 3 shows the reservoir of FIG. 2, when the reservoir is occupied by ink.

FIG. 3 shows the reservoir 201 of FIG. 2, when the reservoir 201 is occupied by ink 320. When ink 320 is present in the reservoir 201, the ink 320 fills at least a portion 325 of the reservoir 201. When ink 320 is present within the reservoir 201, the structure 205 effectively increases the thermal conductivity of the ink. In other words, the structure 205 increases the thermal conductivity within the portion 325 of the reservoir 201 occupied by the ink 320 to a value greater than the thermal conductivity of the ink 320.

The structure 205 may occupy a substantial amount of the reservoir, e.g., greater than about 25% of the reservoir volume, and/or may occupy a substantial amount of the portion of the reservoir filled with ink, e.g., greater than about 25% of the portion 325 of the reservoir volume filled by ink 320. In some cases, the structure 205 may occupy a majority of the reservoir, e.g., greater than 50% of the reservoir volume, and/or may occupy a majority of the portion 325 of the reservoir 201 filled by the ink 320, e.g., greater than 50% of the portion 325 of the reservoir volume filled by the ink 320.

As illustrated in FIGS. 4-8, the structure 405, 505, 605, 705, 805 may be formed by one or more elements 410, 510, 610, 710, 810, e.g., fibers and/or beads, with apertures 411, 511, 611, 711, 811 between the elements 410, 510, 610, 710, 810. The elements 410, 510, 610, 710, 810 may provide the attributes of increased thermal conductivity, ink filtration, and/or void nucleation sites to the ink jet printer.

In some configurations, elements 410, 510, 610, 710, 810 are thermally conductive. In these configurations, the thermally conductive elements 410, 510, 610, 710, 810 can comprise any material that has a thermal conductivity greater than the thermal conductivity of the ink. In some cases, the thermally conductive elements 410, 510, 610, 710, 810 are made of one or more metals that have thermal conductivity substantially greater than ink, such as nickel, aluminum, iron, copper, silver, gold, etc., or alloys thereof such as stainless steel. The elements may be configured as a metal wool. The elements 410, 510, 610, 710, 810 may have a thermal conductivity in a range of about 10 W/mK to about 430 W/mK at room temperature. When disposed within the reservoir, the thermally conductive elements 410, 510, 610, 710, 810 increase the thermal conductivity within the reservoir. When ink is present in the reservoir, the thermally conductive elements 410, 510, 610, 710, 810 increase the thermal conductivity in the portion of the reservoir filled by the ink. For example, the thermally conductive elements 410, 510, 610, 710, 810 may have a thermal conductivity about 70 to about 1000 times greater than the thermal conductivity of the ink.

Figure 4:
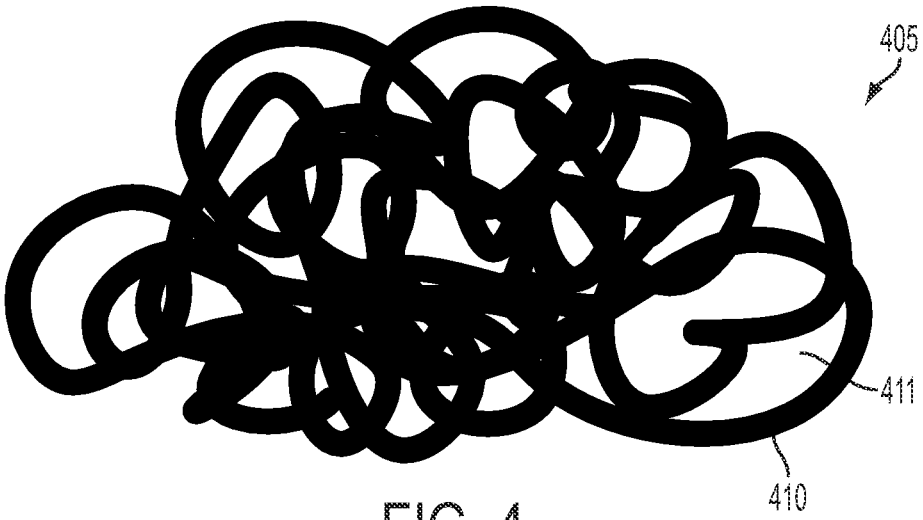
FIG. 4 illustrates a structure having randomly arranged fibers in accordance with some embodiments.
Figure 5:
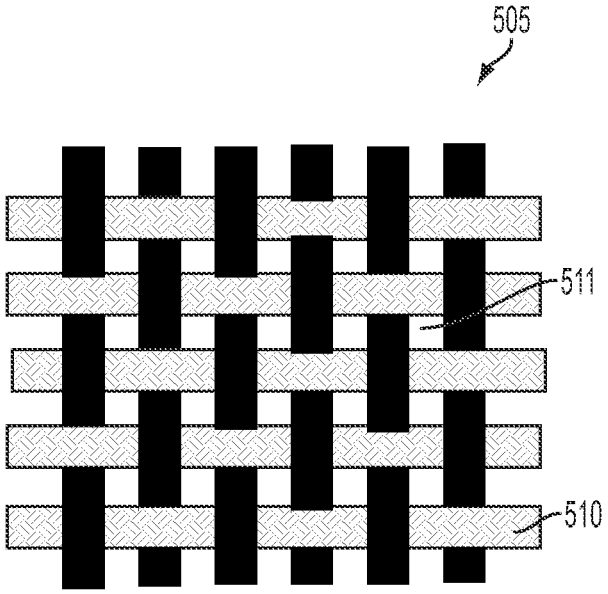
FIG. 5 illustrates a structure having fibers arranged in a woven pattern in accordance with some embodiments.
Figure 6:
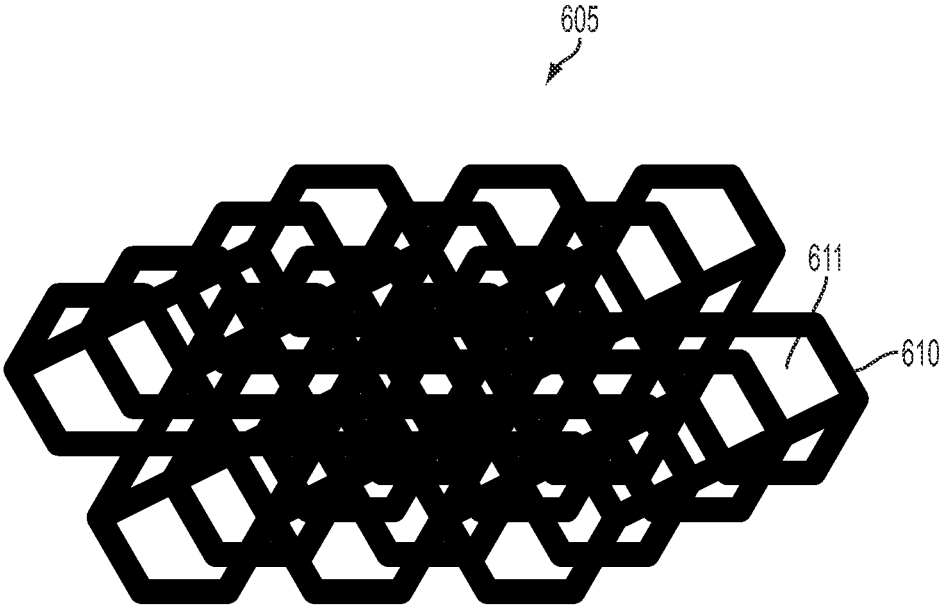
FIG. 6 illustrates a structure having fibers arranged in a non-woven pattern in accordance with some embodiments.
Figure 7:
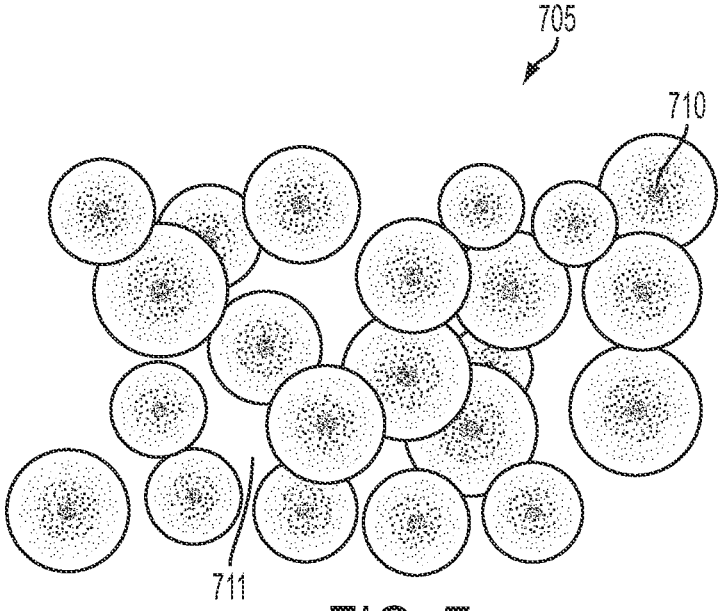
FIG. 7 illustrates a structure having randomly arranged beads in accordance with some embodiments.
Figure 8:
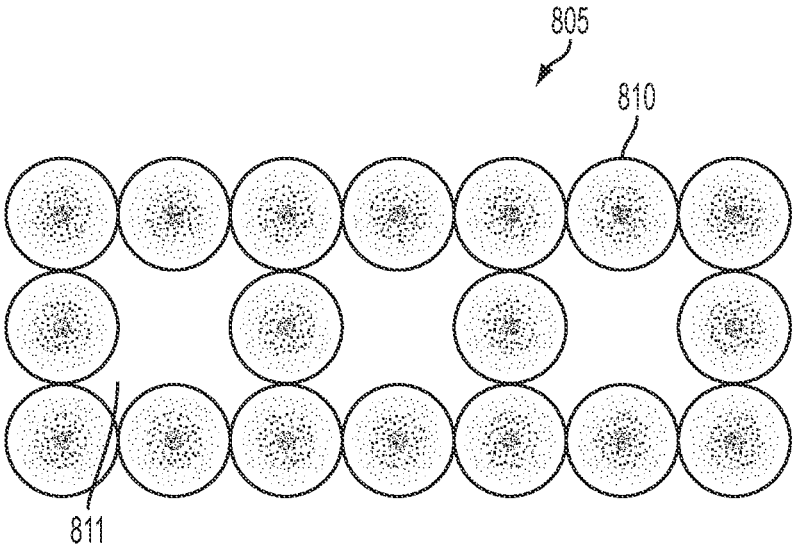
FIG. 8 illustrates a structure having beads arranged in an ordered pattern, in accordance with various embodiments.

The elements 410, 510, 610, 710, 810 of the structure 405, 505, 605, 705, 805 may be arranged randomly, as illustrated by FIGS. 4 and 8, and/or may be arranged in an ordered pattern, as illustrated by FIGS. 5, 6, and 7. The thermally conductive elements 410, 510, 610, 710, 810 may be arranged in a woven pattern as illustrated in FIG. 5 and/or in a non-woven pattern as illustrated in FIGS. 6, 7, and 8. If arranged in a non-woven pattern as in FIGS. 6, 7, and 8, the elements 610, 710, 810 may form a pattern of circles, squares, hexagons, or an ordered pattern of any other geometrical shape or combination of geometrical shapes. FIGS. 4, 5, and 6 depict structures 410, 510, 610 that comprise fibrous elements. FIGS. 7 and 8 depict structures 705, 805 that comprise sintered bead elements 710, 810. The beads 710, 810 may be any shape and are depicted in FIGS. 7 and 8 as having a spheroid shape. The elements 410, 510, 610, 710, 810 may have diameters in a range of about 10 μm to about 50 μm and/or may have an average diameter of about 30 μm. The pores 411, 511, 611, 711, 811 between the elements 410, 510, 610, 710, 810 may have cross sectional areas in a range of about 75 $\mu m^2$ to about 8000 $\mu m^2$ and/or an average cross sectional area of about 705 $\mu m^2$.

Figure 9:
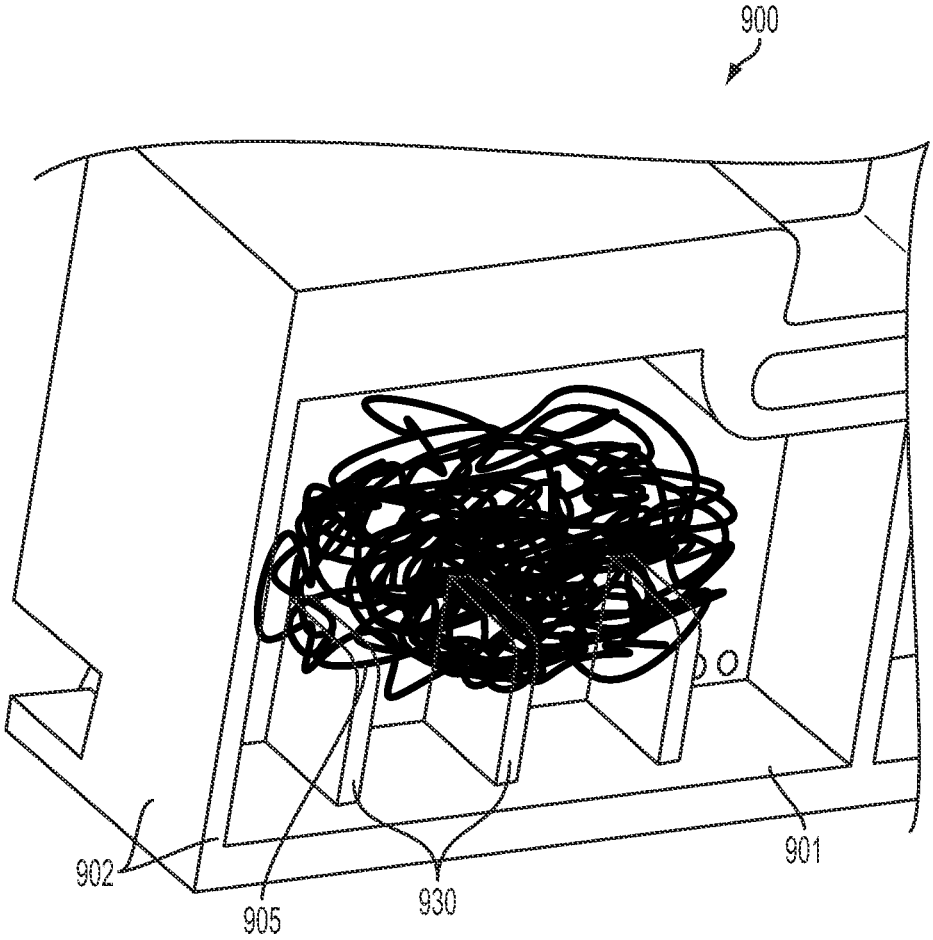
FIG. 9 shows a reservoir of a multi-reservoir subassembly that contains thermally conductive elements and fins in accordance with some embodiments.

FIG. 9 shows a reservoir 901 of a multi-reservoir subassembly 900. As illustrated in FIG. 9, in some implementations, at least one thermally conductive structure 905 may be used in conjunction with one or more fins 930 disposed within the reservoir 901. The fins 930 are also thermally conductive and further increase the thermal conductivity within the reservoir 901. As depicted in FIG. 7, the fins 930 can extend from the reservoir walls 902 into the interior of the reservoir 901. The structure 905 may be disposed in the reservoir 901 in various locations relative to the fins 930, e.g., above, below and/or between the fins 930. In some cases, the structure 905 is mechanically attached to the fins 930 and in some cases, there is no mechanical attachment between the fins 930 and the structure 905.

Figure 10:
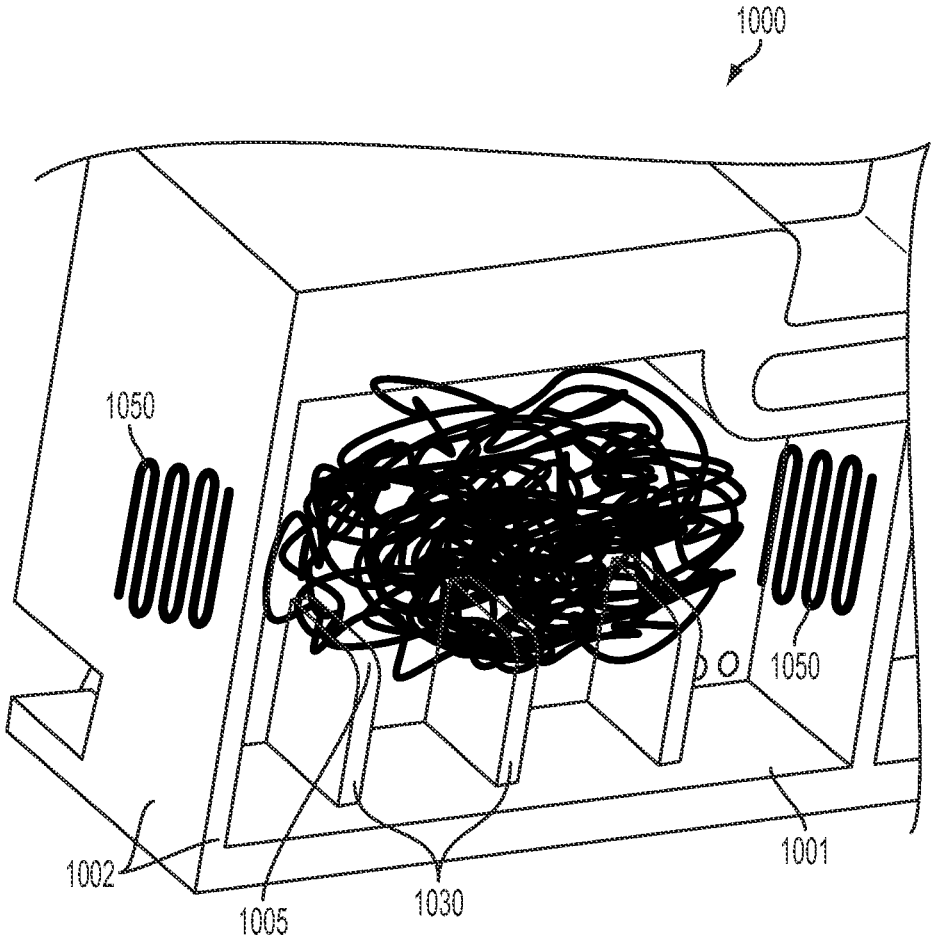
FIG. 10 shows a reservoir of a multi-reservoir subassembly that contains thermally conductive elements and includes heaters disposed along walls of the reservoir in accordance with some embodiments.

As depicted in FIG. 10, a reservoir subassembly 1000 may include one or more heaters 1050, e.g., resistive heaters, that, when used in conjunction with a power supply and/or heater controller (not shown in FIG. 10), are configured to increase and/or maintain the temperature of the ink in the reservoir 1001 above the melting point of the ink. The heaters 1050 may be arranged on one or more of the inner and/or outer surfaces of the walls 1002 of the reservoir 1001 as depicted in FIG. 8. The heaters 1050 and/or may be disposed on one or more fins 1030 and/or may be disposed in other locations. In some configurations, the heaters 1050 may extend into the interior of the reservoir 1001. The heaters 1050 can be mechanically coupled to the fins 1030 and/or can be mechanically coupled to the structure 1005 in such a way that provides good thermal conduction between the heaters 1050 and these components. In various configurations, the heaters 1050 can be mechanically coupled to the structure 1005 by compression, fasteners, and/or other techniques.

Figure 11:
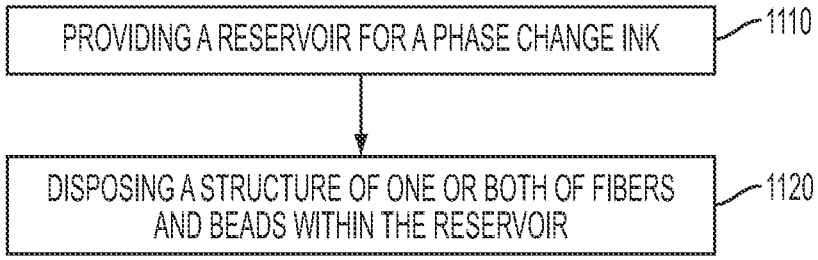
FIG. 11 is a flow diagram of a method of fabricating a reservoir subassembly according to some embodiments.

Some embodiments involve processes for fabricating an ink reservoir subassembly for a phase change ink jet printer. As illustrated by the flow diagram of FIG. 11, a method includes providing 1110 an ink reservoir configured to contain ink. A structure, e.g., fibrous and/or beaded structure, is disposed 1120 within the reservoir. As discussed above, the structure may be thermally conductive to increase the thermal conductivity within the reservoir. The structure may additionally or alternatively provide ink filtration and/or nucleation sites for voids. When ink is present within the reservoir, the structure can increase the thermal conductivity within the portion of the reservoir occupied by the ink to a value greater than the thermal conductivity of the ink.

Disposing the structure within the reservoir may involve disposing the structure so that the structure occupies a substantial amount of the reservoir, e.g., greater than about 25% of the reservoir, and/or may be occupy a substantial amount, e.g., greater than about 25% of the portion of the reservoir filled by ink. In some cases, the structure may occupy a majority of the reservoir, e.g., greater than 50% of the reservoir, and/or may be present in a majority of the portion of the reservoir filled with the ink, e.g., greater than 50% of the reservoir portion filled with the ink.

Disposing the fibrous and/or beaded structure may involve disposing thermally conductive fibers and/or beads arranged randomly and/or arranged in an ordered pattern. If arranged in an ordered pattern, the fibers and/or beads may form a woven pattern and/or a pattern of circles, squares, hexagons, or any other geometrical shape or combination of geometrical shapes.

Figure 12:
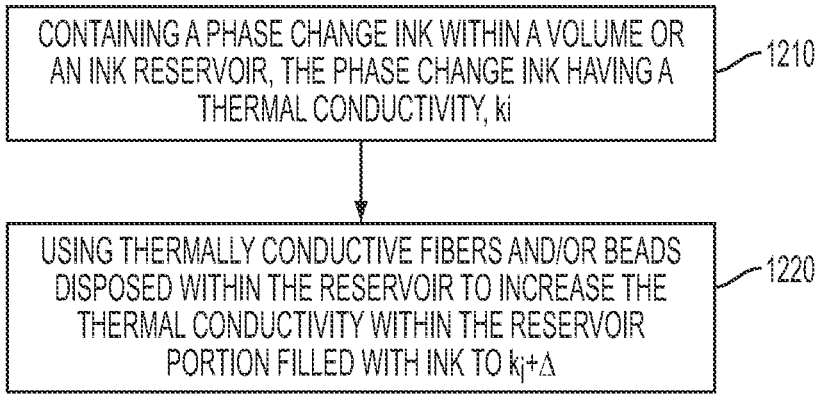
FIG. 12 is a flow diagram of a method of operating a printer according to various example embodiments.

Some embodiments involve methods of operating a phase change ink jet printer, as illustrated by the flow diagram of FIG. 12. A phase change ink having a thermal conductivity of $k_i$ is contained 1210 within an ink reservoir. A structure comprising thermally conductive fibers and/or beads is disposed 1220 within the reservoir to increase the thermal conductivity in the portion of the reservoir filled with the ink to a thermal conductivity of $k_i$+A.

Figure 13:
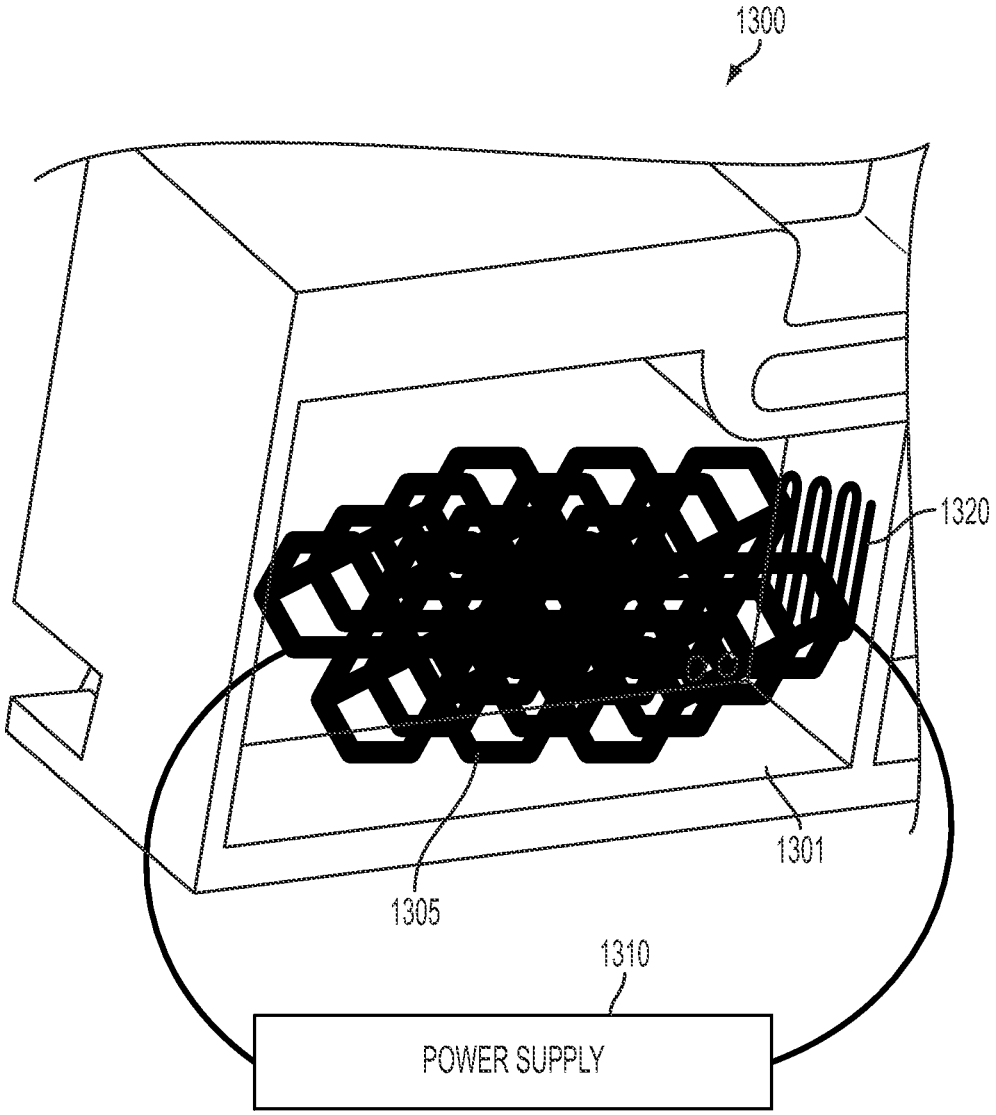
FIG. 13 is a diagram that shows a structure used as a resistive heater component in accordance with some embodiments.

In some implementations, the thermally conductive fibers and/or beads may be a component of the heater system. For example, the structure comprising thermally conductive fibers and/or beads may be used as a portion of a resistive heating element which heats the ink. FIG. 13 shows a reservoir subassembly 1300 that in this example comprises a heater system that includes the structure 1305, power supply 1310, and optional heater 1320. The thermally conductive structure 1305 is disposed within the reservoir 1301 and is electrically coupled to a heater power supply 1310. The heater system may also include one or more resistive heaters 1320 disposed elsewhere in, on, and/or about the reservoir 1301. Electrical current flows through the elements of the structure 1305 and the heaters 1320 to generate resistive heating which heats the ink in the reservoir to a temperature above the ink melting temperature.

Embodiments discussed herein involve the addition of a structure, such as a coarse metal wool, to be inserted into the ink reservoir to effectively improve the thermal conductivity of the ink volume. The embodiments discussed herein can provide a relatively low cost solution when compared, for example, to fabrication of more complex fin geometries. The fibers and/or beads of the structure, e.g., metal wool fibers, can be randomly oriented or patterned, e.g., in a woven pattern, depending on the fiber and/or bead density desired. In some cases, the fibers and/or beads are not directly connected to the walls of the reservoir. If the fibers and/or beads are coupled to the walls of the reservoir, this arrangement may enhance the heat transfer between the fibers and/or beads and the reservoir walls. The thermal conductivity of the various materials, e.g., metals, which could be used to form the fibers and/or beads, is substantially higher than the thermal conductivity of the ink. For example, the thermal conductivity of stainless steel is greater than the thermal conductivity of ink by a factor of 70 and the thermal conductivity of aluminum is greater than the thermal conductivity of ink by a factor of 1000. One possible material that could be used as the thermally conductive mass is 316L stainless steel mesh part number 325X2300TL0014W48T available from TWP. These filter mesh materials provide good heat transfer and can be used in ink contact environments.

The use of the thermally conductive fibers and/or beads in the ink reservoir is a low cost solution that substantially reduces warm-up time at the expense of some melted ink storage volume. As discussed above, the thermally conductive fibers and/or beads may be mechanically connected to the heater elements such as by compression or by fasteners. However, a major component of the thermal conductivity improvement, increasing the effective conductivity of the ink, may be achieved without connection to heater elements.

In addition to reducing warm up time, a fibrous and/or beaded mass in the ink reservoir can also provide void control. Ink generally shrinks when freezing, leaving voids that become bubbles upon melting. These bubbles need to be purged from the system to ensure proper printing. With the fibrous and/or beaded mass in the reservoir, during freezing, the fiber and/or beaded surfaces provide nucleation sites for the voids, which produce smaller, more numerous voids. Smaller voids are more likely to re-dissolve into the ink upon re-melt than larger voids that form in the open reservoir space.

A fibrous and/or beaded mass in the reservoir can provide additional filtration of the ink and may allow purge ink recirculation without a need for additional filter media. The additional filtration can be achieved using woven metal materials with relatively small pore sizes, e.g., on the order of about 30 μm in diameter.

Systems, devices or methods disclosed herein may include one or more of the features, structures, methods, or combinations thereof described herein. For example, a device or method may be implemented to include one or more of the features and/or processes described below. It is intended that such device or method need not include all of the features and/or processes described herein, but may be implemented to include selected features and/or processes that provide useful structures and/or functionality.

In the foregoing detailed description, numeric values and ranges are provided for various aspects of the implementations described. These values and ranges are to be treated as examples only, and are not intended to limit the scope of the claims. For example, embodiments described in this disclosure can be practiced throughout the disclosed numerical ranges. In addition, a number of materials are identified as suitable for various facets of the implementations. These materials are to be treated as exemplary, and are not intended to limit the scope of the claims. The foregoing description of various embodiments has been presented for the purposes of illustration and description and not limitation. The embodiments disclosed are not intended to be exhaustive or to limit the possible implementations to the embodiments disclosed. Many modifications and variations are possible in light of the above teaching.

What is claimed is:

1. An ink reservoir subassembly for phase change ink, comprising:

an ink reservoir where melting of the phase change ink from a solid to a liquid occurs, the ink reservoir having one or more thermally conductive fins disposed within the ink reservoir, wherein each of the thermally conductive fins extends from a wall of the ink reservoir into an interior of the ink reservoir;

resistive heaters mechanically coupled to the fins; and at least one structure comprising one or more thermally conductive elements, the thermally conductive elements including one or both of thermally conductive fibers and thermally conductive beads, the thermally conductive elements disposed within the ink reservoir, electrically coupled to the resistive heaters such that current flows through the conductive elements to generate resistive heating, and arranged to increase a thermal conductivity within the ink reservoir.

2. The ink reservoir subassembly of claim 1, wherein the thermally conductive elements comprise metallic fibers.

3. The ink reservoir subassembly of claim 1, wherein the thermally conductive elements have a thermal conductivity in a range of 10 to 430 W/m-K.

4. The ink reservoir subassembly of claim 1, wherein an average diameter of the thermally conductive elements is about 30 μm.

5. The ink reservoir subassembly of claim 1, wherein pores between the thermally conductive elements have an average cross sectional area of about 705 $\mu m^2$.

6. The ink reservoir subassembly of claim 1, wherein the at least one structure occupies a majority of a volume of the reservoir.

7. The ink reservoir subassembly of claim 1, wherein the at least one structure comprises several structures that occupy separate regions within the reservoir.

8. An ink reservoir subassembly for phase change ink, comprising:

an ink reservoir having one or more thermally conductive fins disposed within the reservoir, wherein each of the thermally conductive fins extends from a wall of the reservoir into an interior of the reservoir;

heaters; and at least one structure comprising one or more thermally conductive elements, the thermally conductive elements including one or both of thermally conductive fibers and thermally conductive beads, the thermally conductive structure disposed within the ink reservoir and arranged to increase a thermal conductivity within the ink reservoir, wherein the heaters are mechanically coupled to the fins.

9. The ink reservoir subassembly of claim 8, wherein the at least one structure is mechanically coupled to the fins.

10. An ink jet printer, comprising:

one or more ink reservoirs adapted to contain a phase change ink where melting of the phase change ink from a solid to a liquid occurs, the one or more ink reservoirs having one or more thermally conductive fins disposed within one or more of the ink reservoirs, wherein each of the thermally conductive fins extends from a wall of the one or more ink reservoirs into an interior of the one or more ink reservoirs;

at least one structure comprising one or more thermally conductive elements, the thermally conductive elements including at least one of fibrous elements and beaded elements disposed within at least one ink reservoir;

a resistive heater mechanically coupled to the fins, the resistive heater configured to heat the ink to a temperature above a melting point of the ink, the at least one structure coupled to the resistive heater such that current flows through the conductive elements to generate resistive heating; and a print head comprising ink jets configured to eject the ink toward a print medium according to predetermined pattern.

11. A method of fabricating a reservoir subassembly for a phase change ink jet printer, comprising:

providing a reservoir configured to contain a phase change ink, the reservoir configured to have one or more thermally conductive fins disposed within the reservoir, wherein each of the thermally conductive fins extends from a wall of the reservoir into an interior of the reservoir;

heating the ink using heaters mechanically coupled to the fins; and facilitating thawing of the phase change ink by disposing at least one structure within the reservoir, wherein the at least one structure includes one or more thermally conductive elements comprising one or both of fibers and beads and occupies a majority of a volume of the reservoir.

12. The method of claim 11, wherein disposing the at least one structure within the reservoir comprising disposing elements having an average diameter of about 30 μm within the reservoir.

13. An ink reservoir subassembly for phase change ink, comprising:

an ink reservoir having one or more thermally conductive fins disposed within the reservoir, wherein each of the thermally conductive fins extends from a wall of the ink reservoir into an interior of the ink reservoir;

heaters mechanically coupled to the fins; and at least one structure disposed within the ink reservoir, the structure occupying a majority of a volume of the ink reservoir, wherein the at least one structure comprises one or more thermally conductive elements, the thermally conductive elements including one or both of thermally conductive fibers and thermally conductive beads, the structure disposed within the ink reservoir and arranged to increase a thermal conductivity within the ink reservoir.

14. The subassembly of claim 13, wherein the one or more elements comprises one or both of thermally conductive fibers and beads.

15. The subassembly of claim 13, wherein the one or more elements comprises one or both of randomly oriented fibers and randomly oriented beads.

16. The subassembly of claim 13, wherein the one or more elements comprises woven fibers.

17. The subassembly of claim 13, wherein the one or more elements comprise sintered beads.

18. The subassembly of claim 13, wherein the one or more elements comprises one or both of fibers or beads having an average diameter in a range of about 10 μm to about 50 μm.

19. The subassembly of claim 13, wherein the one or more elements comprises one or both of fibers and beads and cross sectional area of pores between the elements is in a range of about 75 $\mu m^2$ to about 8000 $\mu m^2$.

20. A method of operating an ink jet printer, comprising:

containing a phase change ink within a volume of an ink reservoir of the ink jet printer, the phase change ink having a thermal conductivity, $k_i$;

heating the ink using heaters;

using thermally conductive fins disposed within the ink reservoir, wherein each of the thermally conductive fins extends from a wall of the ink reservoir into an interior of the ink reservoir and is mechanically coupled at least one heater;

using a thermal structure disposed within the ink reservoir and occupying at least about 25% of a volume of the reservoir, the thermal structure increasing a thermal conductivity within the volume to a thermal conductivity, $k_i+\Delta$, the thermal structure including one or both of thermally conductive fibers and thermally conductive beads.

* * * * *